US009877545B1

(12) United States Patent
Koo et al.

(10) Patent No.: US 9,877,545 B1
(45) Date of Patent: Jan. 30, 2018

(54) HIGH-HEELED SHOE WITH THICKENING CUSHION

(71) Applicant: Dynasty Footwear, Ltd., El Segundo, CA (US)

(72) Inventors: John C. S. Koo, Los Angeles, CA (US); Paul S. Kaufman, Santa Monica, CA (US)

(73) Assignee: Dynasty Footwear, Ltd., El Segundo, CA (US)

( * ) Notice: Subject to any disclaimer, the term of this patent is extended or adjusted under 35 U.S.C. 154(b) by 274 days.

(21) Appl. No.: 14/705,520

(22) Filed: May 6, 2015

Related U.S. Application Data

(63) Continuation of application No. 13/343,627, filed on Jan. 4, 2012, now Pat. No. 9,032,644.

(51) Int. Cl.
*A43B 13/18* (2006.01)
*A43B 3/12* (2006.01)
*A43B 21/24* (2006.01)

(52) U.S. Cl.
CPC ..... *A43B 21/24* (2013.01)

(58) Field of Classification Search
CPC ..... A43B 13/28; A43B 13/34; A43B 7/1425; A43B 7/142; A43B 3/12
USPC ..... 36/44, 30 R, 11.5, 37
See application file for complete search history.

(56) References Cited

U.S. PATENT DOCUMENTS 1,685,827 A 10/1928 Saklad
2,150,385 A 3/1939 Roy et al.
2,212,613 A * 8/1940 Messina ..... A43B 21/32 36/37
2,227,429 A 1/1941 Austin
2,299,840 A 10/1942 Merritt
2,433,329 A 12/1947 Adler et al.
2,838,776 A 6/1958 Tax
2,845,640 A 8/1958 Murray
2,917,757 A 12/1959 Scholl
3,673,714 A 7/1972 Procopio
3,738,373 A 6/1973 Glancy
4,073,024 A 2/1978 Stix
4,306,320 A 12/1981 Delp
4,434,518 A 3/1984 Watanabe
4,882,856 A 11/1989 Glancy
4,896,440 A 1/1990 Salaverria
5,625,965 A 5/1997 Blissett et al.
(Continued)

OTHER PUBLICATIONS

Prosecution history of parent U.S. Appl. No. 13/343,627 (now U.S. Pat. No. 9,032,644).

*Primary Examiner* — Sharon M Prange
*Assistant Examiner* — Timothy K Trieu
(74) *Attorney, Agent, or Firm* — Joseph G. Swan, P.C.

(57) ABSTRACT

A shoe includes a sole having an insert piece and a layer of material disposed on a top surface of the insert piece; and an upper extending above the sole. The insert piece extends from at least one of a front or middle portion of the shoe to a rear of the shoe, with the top surface of the insert piece inclined upwardly toward the rear of the shoe and then leveling off at a rear portion of the shoe. A top surface of the layer of material is inclined upwardly from the at least one of the front or middle portion of the shoe to the rear of the shoe, such that at the rear portion of the shoe an angle of inclination is significantly greater for the top surface of the layer of material than for the top surface of the insert piece.

19 Claims, 5 Drawing Sheets

(56) References Cited

U.S. PATENT DOCUMENTS

| | | | | |
|---|---|---|---|---|
| 5,732,481 | A * | 3/1998 | Farhad | A43B 7/14 36/37 |
| 5,896,678 | A | 4/1999 | Ganon | |
| 5,901,394 | A | 5/1999 | Greenawalt | |
| 6,452,120 | B1 | 9/2002 | Chen | |
| 6,691,360 | B2 | 2/2004 | Mukherjee et al. | |
| 7,152,341 | B2 | 12/2006 | Dean | |
| 7,752,695 | B2 | 7/2010 | Kaufman et al. | |
| 8,336,230 | B2 | 12/2012 | Crowley et al. | |
| 8,393,092 | B2 | 3/2013 | Georgoulakis | |
| 2003/0200675 | A1 | 10/2003 | Gross | |
| 2007/0234590 | A1 | 10/2007 | Morales et al. | |
| 2009/0119947 | A1 | 5/2009 | Orvitz | |
| 2010/0122475 | A1 | 5/2010 | Purrington et al. | |
| 2010/0269375 | A1* | 10/2010 | Georgoulakis | A43B 7/142 36/30 R |
| 2012/0055044 | A1 | 3/2012 | Dojan et al. | |

* cited by examiner

HIGH-HEELED SHOE WITH THICKENING CUSHION

FIELD OF THE INVENTION

The present invention pertains to footwear and techniques for making footwear, and is particularly applicable to an article of footwear having an insert piece included within its sole.

BACKGROUND

Certain shoes have a wedge or other type of insert in their heel portions. Often, a wedge insert is used to elevate the shoe's heel and to provide added strength or rigidity. Typically, the top surface of such an insert follows the contour of the upper surface of the shoe's sole, thereby providing support at every point along the wearer's foot.

Conventionally, such a shoe often is constructed by cutting out different layers that ultimately will make up the shoe's sole (i.e., the portion of the shoe that is beneath the wearer's foot) and then bonding those layers together using an adhesive material. However, prior to bonding two of such adjacent layers together, a wedge of the desired shape is inserted at the back of the shoe between such two adjacent layers. Then, instead of bonding the upper and lower layers directly together along their entire surface areas, the upper layer is bonded to the top surface of the wedge and the lower layer is bonded to the bottom surface of the wedge. For the portion of the shoe that is forward of the wedge, the two adjacent layers generally are bonded directly to each other.

Once all of the foregoing steps have been completed, the sides of the shoe's sole are ground down, in order to smooth out any sections where the layers do not match precisely, to de-emphasize any seams between the layers (e.g., to provide the appearance of a single non-layered material), and to provide any desired shaping of the sole's side surfaces (e.g., to provide rounding, grooves or other three-dimensional patterns).

Previously, the inventors listed in U.S. patent application Ser. No. 12/792,401 (the '401 application, now U.S. Pat. No. 8,914,992) discovered that, when using the conventional production technique described above, because a significant portion of the insert's side walls also are exposed, the grinding of the layers comprising the shoe's sole almost necessarily results in grinding at least a portion of the inserted wedge. That is, even manual grinding usually could not be limited strictly to the other layers of the shoe's sole; some of the grinding would overlap onto the sides of the insert. Any attempts to prevent such overlap generally would require extreme care that would substantially increase the cost of the finished product and, therefore, would be unfeasible for mass, medium-scale or large-scale production. The end result would be that at least some portion of the inserted wedge (e.g., along its bottom and top edges) also would be ground down.

For some shoes, this result was acceptable or even desirable. The best example of such a case was where there was a desire for the shoe's heel to have a uniform appearance, i.e., so that there is no indication that the heel is in fact comprised of multiple layers and a separate wedge. Depending upon the type of grinding surface that is used, the side walls of the shoe's heel would appear to be uniformly smooth or textured.

However, the '401 application observed that such a manufacturing technique limits the types of wedges and other inserts that can be used within a shoe's sole, as well as the variety of shoe designs that can be made with an insert. For example, using such a conventional technique generally precludes one from inserting a decorative wedge, or at least one that has a fully decorated outer surface, because the subsequent grinding generally would obliterate such surface decorations. At the same time, simply omitting the grinding step generally would have the undesirable effect of leaving intact any production imperfections that exist after the individual layers have been bonded together.

The '401 application addressed this problem by providing a production technique in which a temporary insert is placed into the heel of a shoe (e.g., to provide the shoe with its desired final shape) during the grinding process. Then, upon completion of the grinding process, the temporary insert is removed and replaced with the desired permanent insert.

Thus, in one aspect, the '401 application was directed to systems, methods and techniques for making a shoe sole, in which a shoe sole is preliminarily assembled by bonding together a plurality of layers with a temporary insert disposed between two adjacent layers. Then, an outer edge of the shoe sole is ground and, following that, the temporary insert is removed and a permanent insert is bonded in place of the temporary insert, such that the permanent insert forms a portion of a side wall of the shoe sole.

By virtue of the foregoing arrangement, it is possible, e.g., to produce a wide variety of shoes with decorative inserts, which would not be possible, or at least would be significantly more difficult and expense to produce, using conventional techniques. However, it remains very desirable to have additional improvements, particularly with regard to the use of insert pieces within the heel portions of shoes.

SUMMARY OF THE INVENTION

Generally speaking, the present invention addresses this need by providing shoes having soles with novel configurations, as well as systems, methods and techniques for manufacturing such shoes.

According to one representative embodiment, a shoe includes a sole having an insert piece and a layer of material disposed on a top surface of the insert piece; and an upper extending above the sole. The insert piece extends from at least one of a front or middle portion of the shoe to a rear of the shoe, with the top surface of the insert piece inclined upwardly toward the rear of the shoe and then leveling off at a rear portion of the shoe. A top surface of the layer of material is inclined upwardly from the at least one of the front or middle portion of the shoe to the rear of the shoe, such that at the rear portion of the shoe an angle of inclination is significantly greater for the top surface of the layer of material than for the top surface of the insert piece. The layer of material is substantially more cushioning than the insert piece above a portion of the insert piece where the top surface of the insert piece has leveled off.

The foregoing summary is intended merely to provide a brief description of certain aspects of the invention. A more complete understanding of the invention can be obtained by referring to the claims and the following detailed description of the preferred embodiments in connection with the accompanying figures.

BRIEF DESCRIPTION OF THE DRAWINGS

In the following disclosure, the invention is described with reference to the attached drawings. However, it should be understood that the drawings merely depict certain representative and/or exemplary embodiments and features of the present invention and are not intended to limit the scope of the invention in any manner. The following is a brief description of each of the attached drawings.

DESCRIPTION OF THE PREFERRED EMBODIMENT(S)

The present invention is related to the disclosure of U.S. patent application Ser. No. 12/792,401, filed on Jun. 2, 2010, which application is incorporated by reference herein as though set forth herein in full.

General Shoe Insert Considerations

In the preferred embodiments of the invention, the initial steps in a process for making a shoe with an insert are very similar to the conventional process described above, with one significant exception. As in the conventional technique, in the present technique the layers are bonded together with an insert in between two adjacent layers. However, in the present invention, rather than using the same insert that is intended to be a permanent part of the shoe, a temporary insert is used during the grinding step.

Figure 1:
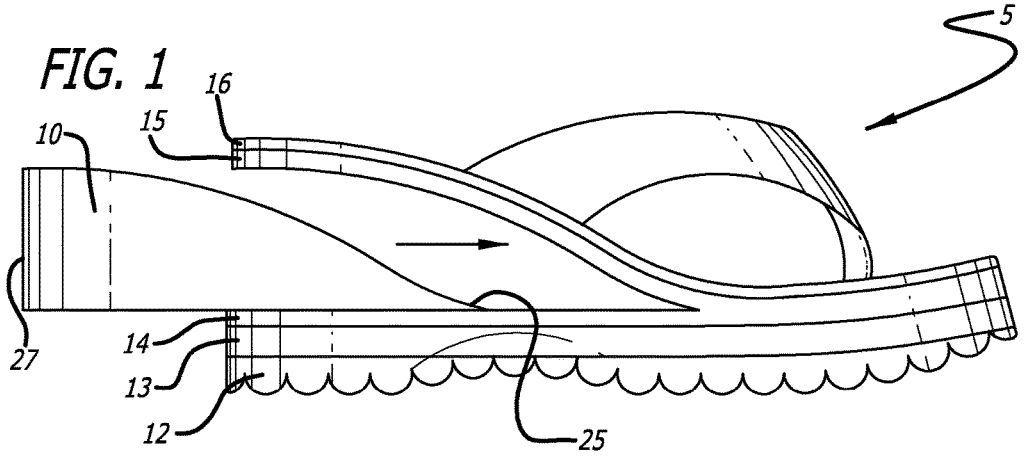
FIG. 1 is an exploded right side elevational view of a shoe according to a representative embodiment of the present invention.
Figure 2:
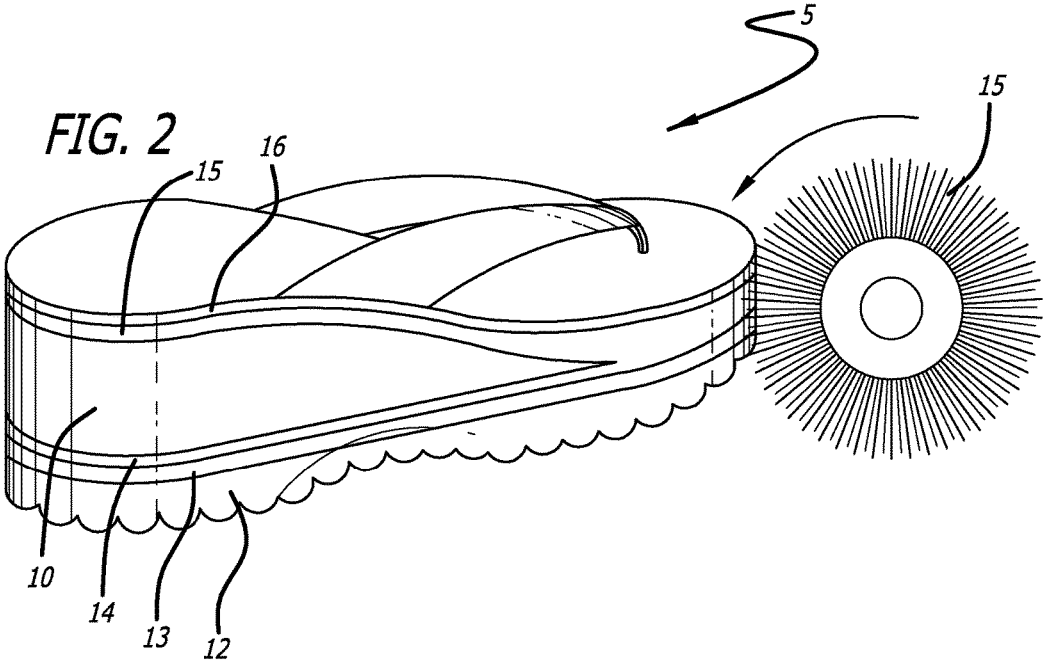
FIG. 2 is a perspective view of a shoe having a temporary insert installed, with its sole being ground, according to a representative embodiment of the present invention.

More specifically, in the production technique according to the present invention, a temporary insert (e.g., wedge 10 in FIGS. 1 and 2) is inserted into the heel of a shoe 5. In the preferred embodiments, the purpose of the temporary insert 10 is to provide the shoe 5 with its desired final shape (e.g., the shape that the shoe 5 will have when the permanent insert 30 is in place) during the grinding step (e.g., using grinder 15), without the necessity of using the insert 30 that will be permanently used in the shoe 5.

Figure 3:
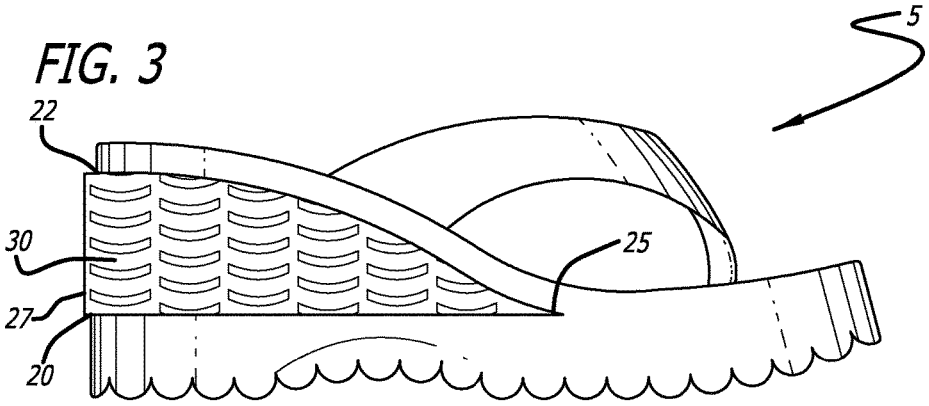
FIG. 3 is a right side elevational view of a completed shoe including a permanent insert according to a representative embodiment of the present invention.

As noted above, and as indicated in FIG. 3, in the present embodiment, the separate layers 12-16 are no longer easily distinguishable after such grinding has been performed. However, in alternate embodiments, where the various layers have different colors, the final appearance will be a single piece with different colored bands.

When the grinding step is completed, the temporary wedge 10 is removed and replaced with the desired insert (e.g., wedge 30 shown in FIG. 3), which is then permanently bonded into place. During the grinding process, the temporary wedge 10 may be held in place with a temporary adhesive, by clamping (e.g., using a C-clamp), by manually holding the temporary insert 10 in place, and/or by using any other temporary holding means. As in the conventional technique, the sides of the permanent insert 30 form a part of the sole's sidewall. However, because a temporary insert 10 is used during the grinding step, the grinding does not cause any damage to the permanent insert 30.

In the preferred embodiments, the temporary insert (e.g., wedge 10) has a shape that is identical or substantially similar to the shape of the desired final insert (e.g., wedge 30). More preferably, with respect to the portion of the wedge that is directly between the two adjacent layers 14 and 15 of the shoe's sole (i.e., within the "footprint" of the sole's other layers 12-16), the temporary wedge 10 has exactly the same (or substantially the same) shape as the desired final wedge 30, thereby providing the same (or substantially the same) shape to the shoe that the desired final wedge 30 would provide. However, the sidewalls of the temporary wedge 10 preferably are substantially smooth and vertical, or even somewhat concave, thereby facilitating the grinding step, even if the desired final wedge 30 will have textured and/or convex sidewalls (which otherwise would be likely to interfere with the grinding step).

By virtue of the foregoing technique, a variety of shoe designs are possible that could not be made in an easy or a cost-effective manner using conventional approaches. For example, as already noted above, the present technique provides for the possibility of using textured wedge inserts 30, even where the texturing covers the entire outer surface of the wedge 30 (or substantially all of such outer surface) and even where such texturing extends to the bottom edge 20 and/or top edge 22 of the wedge 30. Similarly, wedges 30 can be used that are pre-decorated, even where such decoration (e.g., with decals, surface paint or the like) covers the entire outer surface of the wedge 30 (or substantially all of such outer surface) and even where such decoration extends to the bottom edge 20 and/or top edge 22 of the wedge.

Figure 4:
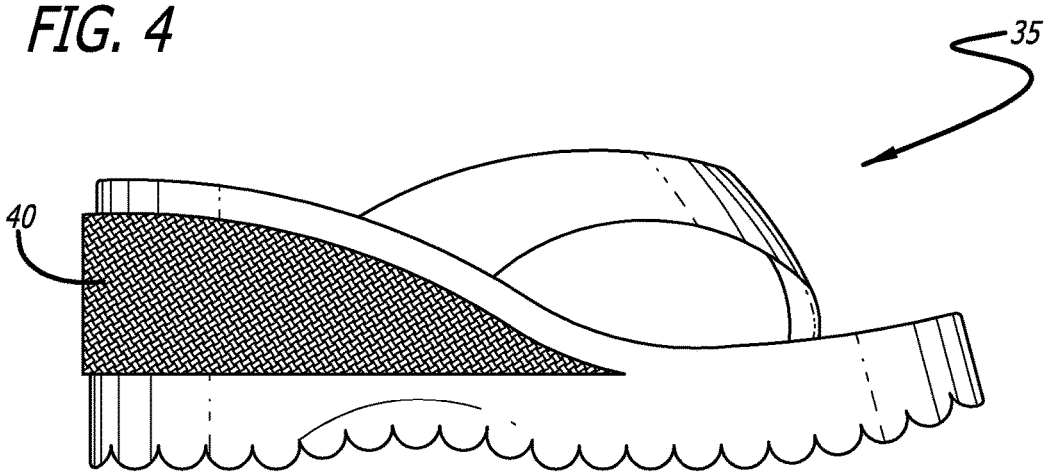
FIG. 4 is a right side elevational view of a completed shoe including a permanent insert having a woven outer surface according to a representative embodiment of the present invention.
Figure 5:
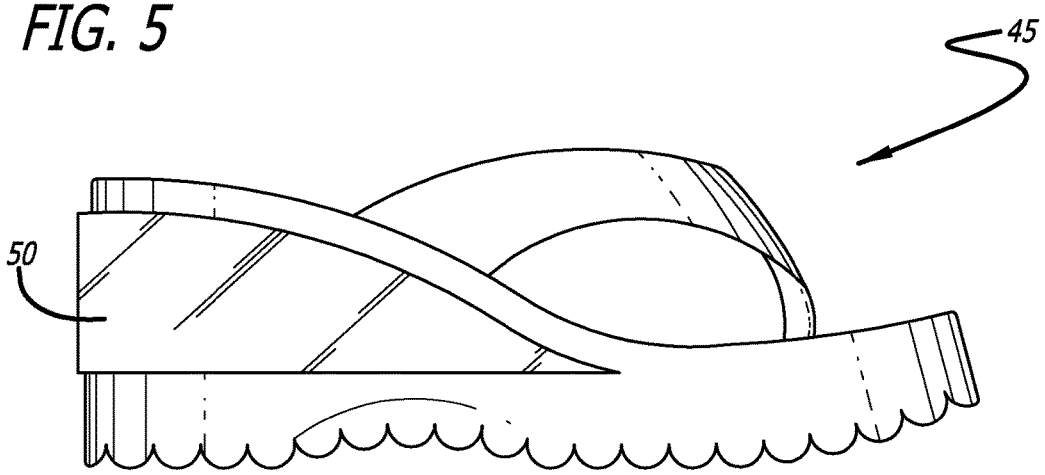
FIG. 5 is a right side elevational view of a completed shoe including a permanent insert having a high-gloss or clear plastic coating on its outer surface according to a representative embodiment of the present invention.

Moreover, such considerations apply whether such texturing and/or other decoration is separately fabricated or is an intrinsic part of the material that is used to form wedge 30. Thus, for example, a wedge 30 used in the technique of the present invention can have a woven outer surface, a rope-like outer surface, a decorative veneer outer surface, a high-gloss coating on its outer surface, a textile wrap, an outer decal, a clear plastic coating, or any other outer surface that otherwise would be damaged by the grinding process. It is noted that in certain conventional techniques, after the sole has been fully constructed and all grinding has been completed, all or a portion of the sidewalls of the shoe's sole are covered or wrapped (e.g., using a veneer); however, for the reasons noted above, such conventional techniques generally would not be conducive to pre-wrapping the insert 30. The decorative pattern shown on insert 30 could have been applied, e.g., by attaching a veneer that includes the pattern, by wrapping insert 30 with a piece of textile that has been printed with such pattern, or by applying an outer decal having the pattern. FIG. 4 illustrates a completed shoe 35 that includes a permanent insert 40 having a woven outer surface, and FIG. 5 illustrates a completed shoe 45 that includes a permanent insert 50 having a high-gloss or clear plastic coating on its outer surface.

In addition, the overall shape of a wedge 30 according to the present invention can have greater variation than conventionally would be possible. For example, such a wedge 30 can be convex or even highly convex, whereas a highly convex surface typically would interfere with the grinding process when using conventional production techniques.

Still further, because the width of the final decorative wedge 30 according to the present invention does not necessarily need to be the same as the width of the adjacent layers 14 and 15 (or any of the layers 12-16) of the shoe's sole, it often will be possible to use a single-sized decorative wedge 30 for multiple different shoe sizes and/or styles. For example, a single wedge 30 might be used with size 6, 7 and 8 shoes. The fact that the wedge 30 might extend further out from the other layers 12-16 of the soles for the smaller shoes generally will not be a problem where the shoe design is intended to feature a "bulging" wedge 30, or where the design can accommodate either "bulging" or "no bulging". As a result, the number of different-sized wedges 30 (each typically requiring its own mold) can be reduced, thereby reducing manufacturing costs even further.

In another aspect of the invention, insert 30 may be structured so as to have a flexibility gradient along its length or to otherwise have differing levels of flexibility. For example, it often will be preferable to make insert 30 more flexible closer to its front end 25 and more rigid at its rear end 27. Also, all or nearly all of insert 30 preferably is behind the flex point of the shoe's sole where the outsole is most likely to bend, thereby helping to avoid cracking of the more flexible parts of layers 12 through 16.

However, it should be noted that all or a portion of insert 30 (e.g., close to front end 25) may extend beyond the flex point of the shoe's sole (e.g., close to front end 25) if that portion of the insert is approximately as flexible as, or more flexible than, layers 12 through 16. For example, certain wedges 30 according to the present invention are constructed from two different types of materials, with the front portion 25 being made from a material having greater flexibility than the material from which the rear portion 27 is made. Further, it should be noted that the use of denser materials often will allow the decorative designs to last longer, e.g., when the outsole strikes or scrapes against any obstacle that otherwise might scratch or gouge the decoration. The use of denser materials on the thicker part of insert 30 (i.e., near rear end 27) also can make the thicker part of the wedge's cushion effect less likely to be compressed.

It is further noted that the foregoing technique is intended for use in a mass-production medium-scale production or large-scale production manufacturing process. Accordingly, the same temporary wedge 10 (or at least the same temporary wedge design) preferably is used for a number of different shoes coming down the production line. Moreover, because the appearance of the temporary wedge 10 is not important, a single wedge 10 (or a single wedge shape) can be used across a range of different styles (and, as noted above, even a range of different sizes) of shoes, subject to any practical considerations.

Still further, it often will even be possible to use molds for existing shoe wedges (which have tended to be rather plain, having smooth vertical side walls) to create the temporary wedges 10 used in the present invention. Alternatively, the temporary wedges 10 may be fabricated as simple cutouts of any desired material. As a result, it may be possible to implement the technique of the present invention with a great deal of operating or manufacturing efficiency.

It should be noted that the foregoing discussion assumes that the insert (both temporary 10 and final 30) is wedge-shaped, increasing in thickness from front 25 to rear 27. This generally will be the case where the shoe has an elevated heel. However, it should be understood that the foregoing production technique also applies to inserts 10 and 30 which have other shapes (e.g., substantially flat in thickness or substantially flat with a tapered front and/or a rear end). Such alternate shapes might be used, e.g., where significant elevation is not necessarily desired, but where the designer still wishes to provide added rigidity, firmness or support in the rear part of the shoe, while at the same time using a decorative element.

In this regard, it is further noted that the final insert 30 itself preferably is firmer, stronger, more rigid or less pliable than the other layers 12-16 that constitute the shoe's sole. The main goal of a final insert 30 in a shoe 5 according to the present invention is to provide rigidity and/or to provide a desired shaping (and/or decorative impact), with the other layers 12-16 of the shoe's sole typically being flat and cut from sheet material(s).

At any desired point during the process described above, a shoe upper (e.g., the separately identifiable portion of the shoe that mainly encloses and/or covers the top and/or side portions of the wearer's foot) may be attached to one or more of the layers of the shoe sole. Alternatively, the shoe upper may be formed as a unitary piece with one or more of the upper layers of the shoe's sole. Any kind of upper may be used, including simple straps in the case of the sandal, thong or similar shoe.

In the embodiments described above, a temporary insert 10 is used in order to avoid damaging the permanent insert 30 during the grinding step. If the grinding step can be omitted in the production technique, then it often will be possible to omit the use of a temporary insert altogether. For example, in one technique the entire shoe sole, or even the entire shoe, is injection molded as a single unitary piece having an opening that is sized and shaped appropriately to accommodate the permanent insert 30, and then the permanent insert 30 is simply bonded into place within that opening. By injection molding the sole (or the entire shoe) as a single piece, rather than bonding together individual layers to form the sole, the grinding step usually will be unnecessary because no seams or other irregularities should be present.

Specific Shoe Insert Configurations

FIGS. 6-9 illustrate various embodiments of shoes and shoe soles according to the present invention. In each of these embodiments, the sole of the shoe includes an insert piece and a layer of material disposed on all or part of the top surface of the insert piece. Preferably, the insert piece is substantially rigid or at least significantly more rigid than the layer of material above it. Stated somewhat differently, the layer of material preferably is substantially more cushioning than the insert piece.

Figure 6:
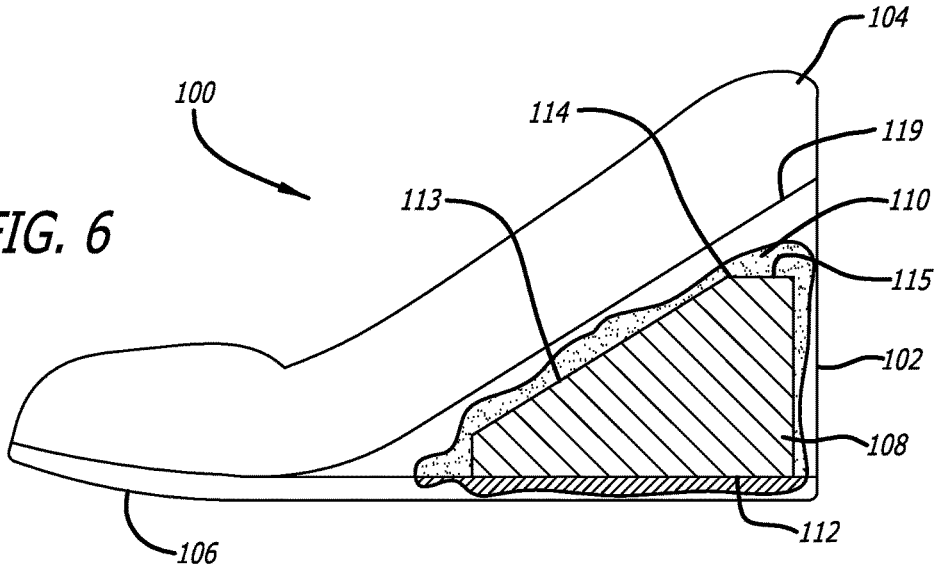
FIG. 6 is a side elevation of a shoe with a partial cutaway of the shoe's sole to expose the insert piece embedded within it.

Referring first to FIG. 6, a shoe 100 includes a sole 102 and an upper 104. Sole 102, in turn, includes an outsole 106, an insert piece 108, and a layer of material 110 above the insert piece 108. In the present embodiment, insert piece 108 is made of a first type of material, which preferably is rigid (e.g., wood or a hard natural or synthetic rubber, a plastic or another polymer, such as ethylene vinyl acetate (EVA), polyvinyl chloride (PVC), thermoplastic rubber (TPR)), and is attached to the top surface of outsole 106 (e.g., using a separate adhesive material), but otherwise is completely embedded within a second type of material that surrounds the sides and top of insert piece 108 and, therefore, also forms the layer 110. Preferably, this second type of material is a single compound, composition or mixture, which is more cushioning (e.g., a foamed or blown natural or synthetic rubber or other material) than the type of material from which insert piece 108 is formed (although the only difference might that air has been injected into the material forming layer 110).

Preferably, insert piece 108 is first separately formed (e.g., using injection or another type of molding) and then the second type of material is molded around it. The entire resulting structure can then be bonded to the top surface of outsole 106, thereby completing formation of the sole 102. Alternatively, one or more additional layers (e.g., an insole and/or a sock layer) may be bonded onto the top surface of layer 110 before the sole 102 is deemed complete.

As with the embodiments described above, although upper 104 is depicted in the current embodiments as having a certain style, in fact any kind of upper (e.g., any conventional upper) instead can be used. Examples include any kind of a generally closed upper (i.e., one that largely or completely envelops the wearer's foot) or any kind of a generally open upper (e.g., consisting of just a couple of straps, but with the top and sides of the wearer's foot being largely exposed). Outsole 106 may be made of any conventional material and/or may be fabricated using any conventional technique.

As shown in FIG. 6, insert piece 108 is wedge shaped at its front end, with a horizontal bottom surface 112 and a top surface 113 that continuously inclines upwardly from its front end toward its rear end until reaching a transition edge 114, after which it levels out, in this case becoming substantially or completely horizontal. Although transition edge 114 is quite sharp and abrupt in the present embodiment, in alternate embodiments it is more rounded or otherwise provides a smoother transition to a significantly smaller (which could be zero or even negative) angle of inclination. Similarly, although the portion 115 of the top surface 113 that is behind transition edge 114 (i.e., the leveled-off portion) is completely horizontal in the present embodiment, in alternate embodiments it instead can just have a smaller angle of inclination (preferably, significantly smaller than the surface in front of the transition edge 114) and, as noted above, could even be a negative angle of inclination (i.e., with the surface declining when moving further toward the rear). Still further, although leveled-off portion 115 is illustrated as being flat, it instead could be somewhat curved (e.g., concave from front to rear and/or from side to side—that is, in just a single dimension or in two dimensions).

While top surface 113 of insert piece 108 levels out (e.g., in one of the ways described above), in the present embodiment the top surface 119 of layer 110 maintains a substantially constant angle of inclination from the front or middle portion of the shoe 100 to the very rear end of shoe 100. Preferably, this angle is the same as the angle of inclination of the top surface 113 of the insert piece 108 at the front portion of insert piece 108. As a result, the thickness of layer 110 is entirely or substantially uniform along this front section of insert piece 108 and then increases where insert piece 108 flattens out. Because the material of layer 110 preferably is substantially more cushioning than the material of insert piece 108, this structure inherently provides additional cushioning at the rear portion of the shoe 100.

In the foregoing embodiment, insert piece 108 is completely embedded within the sole 102, so that it is hidden from view. One advantage of this approach is that the type of material and the corresponding aesthetics of insert piece 108 can be irrelevant to the overall visual effect. On the other hand, in other embodiments the insert piece is visible in the shoe's sole.

Figure 7:
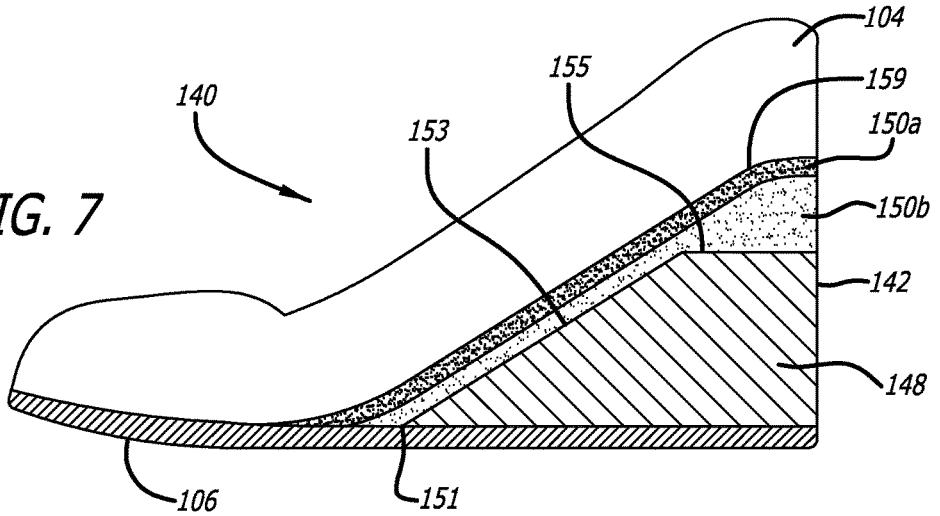
FIG. 7 is a side elevation of a shoe with a visible insert piece in its sole and with the layer above the insert piece being comprised of two sublayers.

FIG. 7 illustrates a shoe 140 according to another representative embodiment of the present invention. Similar to the previous embodiment, shoe 140 includes a sole 142 and an upper 104. Sole 142, in turn, includes outsole 106, an insert piece 148 and a layer of material 150 above some, all or substantially all of the top surface 153 of insert piece 148. Insert piece 148 preferably has the same characteristics as, and could be made of any of the materials described above for, insert piece 108. Its bottom surface preferably is attached to the top surface of outsole 106 (e.g., using a separate adhesive material), and some, all or substantially all of its top surface 153 preferably is attached to layer 150.

In the current embodiment, layer 150 is comprised of two sublayers, top sublayer 150*a* and bottom sublayer 150*b* (although any other number of sublayers instead may be used). The use of multiple sublayers can allow greater flexibility in the physical and/or aesthetic properties provided by layer 150. For example, top sublayer 150*a* might be less dense and therefore provide greater cushioning while bottom sublayer 150*b* might be more dense and/or inflexible (e.g., but not as dense or rigid as insert piece 148) and therefore provide better isolation from the more-rigid insert piece 148. Alternatively, the foregoing properties of the two sublayers could be reversed. Overall, however, layer 150 preferably provides more (e.g., significantly more) cushioning than insert piece 148.

Either or both of top sublayer 150*a* and bottom sublayer 150*b* can have the same characteristics as, and/or be formed from any of the same materials described above for, layer 110. Conversely, it should be noted that layer 110 also could comprise multiple sublayers.

Insert piece 148 can be separately formed (e.g., using injection molding). Layer 150 can then be molded on top of it (e.g., one sublayer at a time), can be performed separately and then bonded to insert piece 148 (e.g., using a separate adhesive material), or any combination of the foregoing techniques can be used (e.g., with respect to the separate sublayers 150*a* and 150*b*). In any event, the entire resulting structure can then be bonded to the top surface of outsole 106, thereby completing formation of the sole 142. Alternatively, one or more additional layers (e.g., an insole and/or a sock layer) may be bonded onto the top surface of layer 150 before the sole 142 is deemed complete. Still further, the entire sole 142, the majority of sole 142, or any portion of it, can the formed using a multistep molding process or any other conventional techniques.

As shown in FIG. 7, insert piece 148 is similar in shape to insert piece 108 (e.g., wedge shaped at its front end), except that the front end 151 of insert piece 148 has a thinner edge, and its leveled-out portion 155 is longer (e.g., represents a greater portion of its top surface 153) than the corresponding leveled-out portion 115 of shoe 100. Otherwise, the same considerations that pertain to leveled-out portion 115 (discussed above) also pertain to leveled-out portion 155 of the present embodiment.

Another distinction between the present embodiment and the previous one is that the top surface 159 of the top layer 150 in the current embodiment also levels out at the rear portion of the shoe 140. However, it does so further back and more gradually than the top surface 153 of insert piece 148. What this means is that for a significant part of the rear portion of the shoe 140, the angle of inclination of the top surface 159 is still significantly greater than the angle of inclination of the top surface 153, so that top layer 150 still is thicker at the rear portion of the shoe 140. This additional thickness can be divided between the top sublayer 150*a* and the bottom sublayer 150*b* in any desired proportions, with such proportions potentially changing at different points in order to achieve any desired effect.

Figure 8:
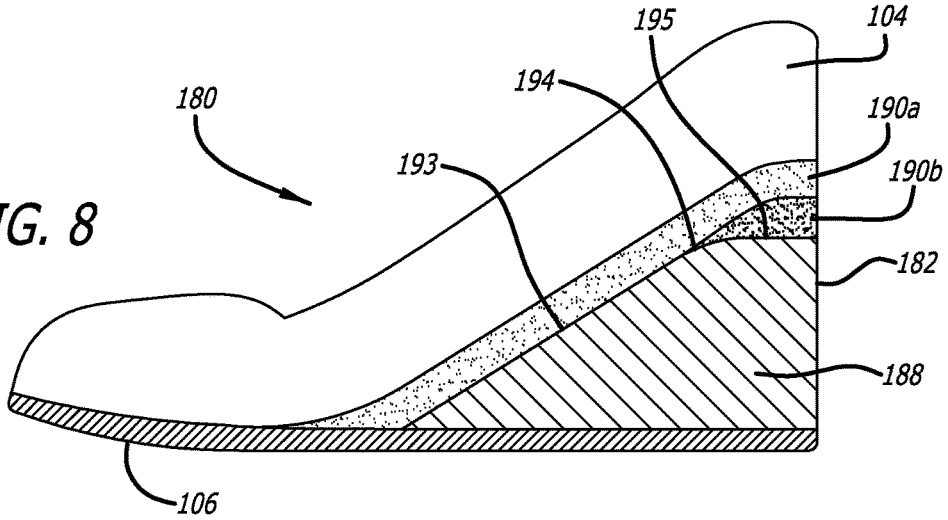
FIG. 8 is a side elevation of a shoe with a visible insert piece in its sole and a separate cushioning element that is disposed only above the leveled-out portion of the insert piece.
Figure 9:
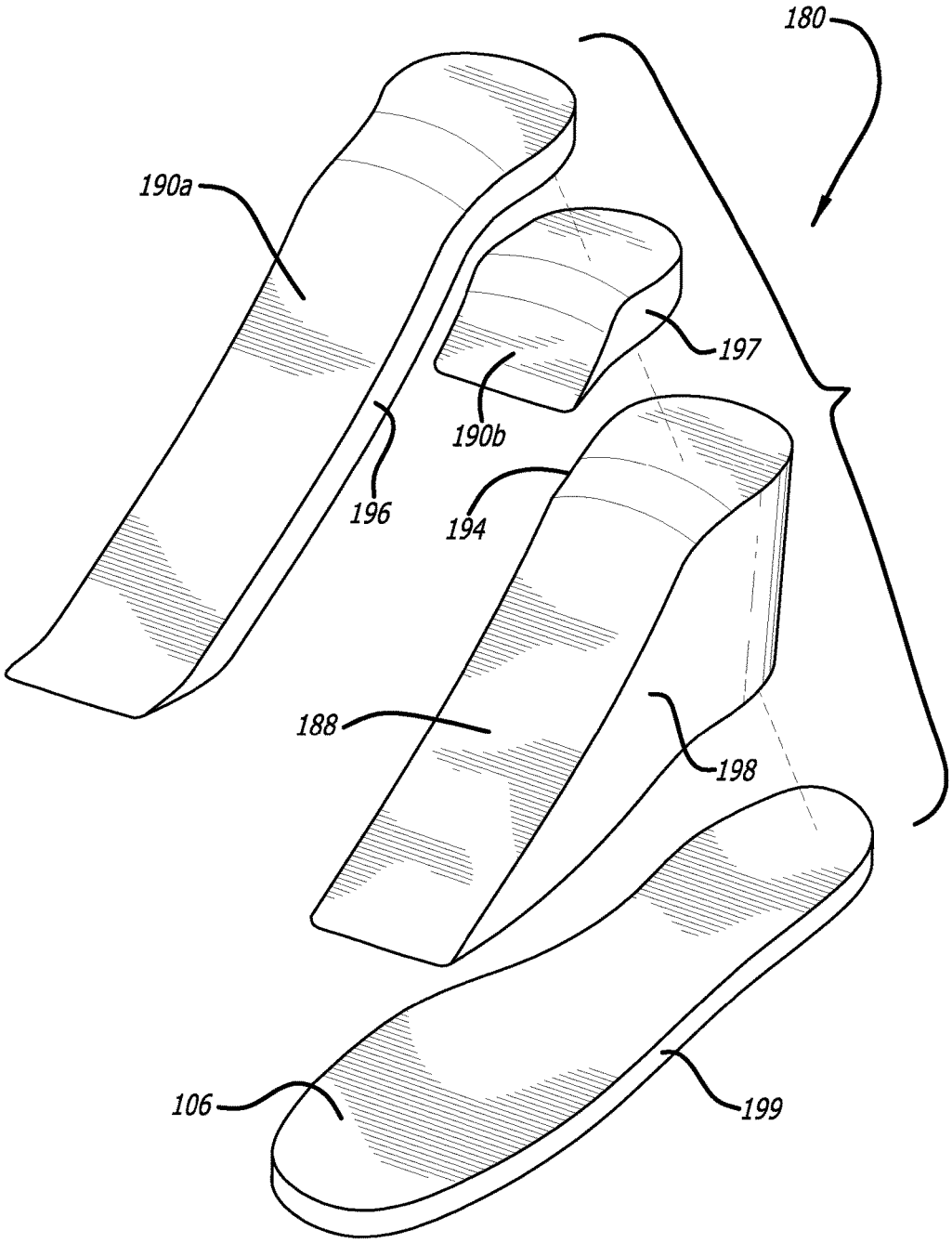
FIG. 9 is an exploded perspective view of the sole of the shoe illustrated in FIG. 8.

FIGS. 8 and 9 illustrate a still further embodiment in which a shoe 180 includes a sole 182 and an upper 104. Sole 182, in turn, includes outsole 106, an insert piece 188, and a layer of material 190 above some, all or substantially all of insert piece 188. Insert piece 188 preferably has the same characteristics as, and could be made of any of the materials described above for, insert piece 108. Its bottom surface preferably is attached to the top surface of outsole 106 (e.g., using a separate adhesive material), and its top surface preferably is attached to layer 190. As in the immediately preceding embodiment, layer 190 is comprised of two sublayers, top sublayer 190*a* and bottom sublayer 190*b* (although, as in the preceding embodiment, any other number of sublayers instead may be used). However, unlike the preceding embodiment, in the present embodiment bottom sublayer 190*b* covers significantly less area than top sublayer 190*a*. More specifically, in this embodiment bottom sublayer 190*b* is disposed only above the leveled-out portion 195 of the top surface 193 of the insert piece 188. Preferably, bottom sublayer 190*b* is configured as a cushioning element (e.g., providing greater cushioning than top sublayer 190*a*). In any event, layer 190 preferably provides more cushioning than insert piece 188, and either or both of top sublayer 190*a* and bottom sublayer 190*b* can have the same characteristics as, and/or be formed from any of the same materials described above for, layer 110. Similarly, layer 110 could have the same (or similar) configuration as layer 190.

In the preferred embodiment, each of insert piece 188, top sublayer 190*a*, bottom sublayer 190*b* and outsole 106 is formed separately (e.g., using injection molding) and then all of such components are bonded together (e.g., using a separate adhesive material). However, any other (e.g., conventional) techniques instead can be used to form sole 182.

As shown in FIGS. 8 and 9, insert piece 188 is similar in shape to insert piece 148 (e.g., wedge shaped at its front end and then leveling out). However, in the current embodiment the transition region 194 to the leveled-out portion 195 is smoother (e.g., less abrupt). Once again, the same considerations that pertain to leveled-out portion 115 (discussed above) also pertain to leveled-out portion 195 of the present embodiment.

In each of the foregoing embodiments, the insert piece (108, 148 or 188) extends from the front or middle portion of the shoe (or, correspondingly in these embodiments, the shoe sole) to the rear of the shoe. In addition, in each such embodiment the insert piece increases in thickness from the front or middle portion of the shoe toward the rear of the shoe, with the top surface of the insert piece inclining upwardly from the front or middle of the shoe toward the rear of the shoe. However, at a rear portion of the shoe (preferably, the rearmost portion of the shoe), the top surface of the insert piece levels off (e.g., its angle of inclination decreases significantly), preferably so that it becomes entirely or substantially horizontal.

It is noted that in the present embodiments the bottom surface of the insert piece is entirely or substantially horizontal. However, in alternate embodiments the bottom surface of the insert piece can have any other configuration. Also, in the present embodiments the top surface of the insert piece inclines continuously and at a constant angle up until the transition edge. However, in alternate embodiments any other configuration, preferably involving an overall inclination to the transition (e.g., edge 114 or region 194), instead can be used.

As indicated above, in any embodiment, the layer of material (110, 150 or 190) above the insert piece can be formed from a single, uniform type of material or instead could be formed from two or more layers. Similarly, the layer of material can have two or more different sections (which sections could overlap partially, entirely or not at all). When using plural layers and/or sections, the different layers and/or sections can be made of different kinds of materials to achieve any desired effect, e.g., as noted above.

In any event, in the preferred embodiments, the top surface of the layer of material above the insert piece preferably is substantially parallel to the top surface of the insert piece (i.e., inclined upwardly at substantially the same angle) from the front or middle of the shoe up until the transition (e.g., edge 114 or region 194). At that point, the top surface of the layer of material preferably continues on at a substantially greater angle of incline than the top surface of the insert piece (which has leveled off), at least for a significant distance. In certain embodiments, the top surface of the layer of material preferably continues on at substantially the same angle it had exhibited prior to the transition. As a result, the layer of material ordinarily is much thicker at the rear portion of the shoe than it is within the section of the shoe from the front or middle of the shoe to the transition edge. Also, in the preferred embodiments, the top surface of the layer of material (110, 150 or 190) is, or at least approximately parallels, the surface of the shoe's insole; that is, any additional layers on top of it preferably are of at least approximately uniform in thickness.

As shown in FIG. 9, in the current embodiment the sidewalls 196-199 of components 190*a*, 190*b*, 188 and 106, respectively, collectively function as the sidewall of the shoe's sole 182. However, in alternate embodiments an additional layer (e.g., injection molded or glued on) may be used to wrap around any or all of sidewalls 196-199. In particular, it might be desirable to cover the more cushioning layers, such as components 190*a* and/or 190*b* (as applicable).

Figure 10:
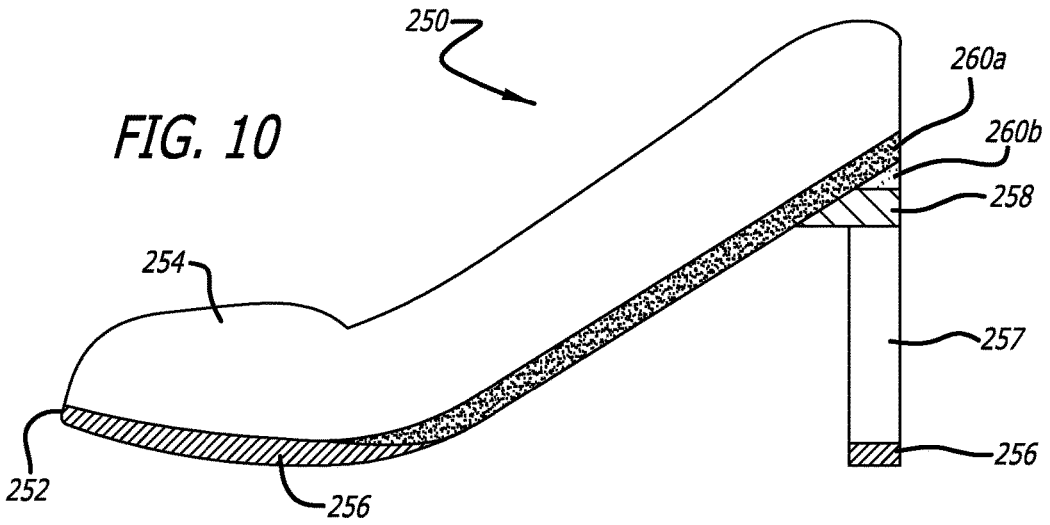
FIG. 10 is a side elevation of a shoe with a spike heel, a leveled-out wedge and a cushioning element that is disposed only above the leveled-out portion of the wedge.

FIG. 10 illustrates a shoe 250 according to an alternate embodiment of the present invention. As shown, shoe 250 includes a sole 252 and an upper 254. Sole 252, in turn, includes an outsole 256, a spike heel 257, a wedge 258, and a layer of material 260 above the wedge 258. These components can have the same properties and considerations as the corresponding components of shoes 140 and 180 (discussed above), except as otherwise noted below.

In the present embodiment, outsole 256 covers only the bottom surface of heel 257 and the front part of the sole 252, approximately from the rear of the metatarsal region to the very front of sole 252. However, in alternate embodiments outsole 256 can cover the entire bottom surface of sole 252 or any portion of it.

Similar to the insert pieces (e.g., 108, 148 and 188) of the previous embodiments, wedge 258 preferably is rigid and could, e.g., be made of any of the same materials. In the present embodiment, wedge 258 is a distinct piece (e.g., separate from and attached to the top of heel 257, with heel 257 being a conventional heel), but in alternate embodiments wedge 258 could be integrated together with heel 257 (e.g., forming a unitary piece). Generally speaking, wedge 258 has a similar shape to the previous insert pieces, but is smaller, extending just a little forward of heel component 257 (e.g., such that its top surface occupies 25-75% of the length of the heel portion of sole 252).

In the current embodiment, layer 260 is comprised of two sublayers, top sublayer 260*a* and bottom sublayer 260*b*, made of different materials (although any other number of sublayers made of different materials instead may be used). Alternatively, layer 260 can be made of a single uniform material. Top sublayer 260*a* is shown as extending approximately from the metatarsal region to the rear of sole 252, but in alternate embodiments can be coextensive with the entire sole 252 or any portion of it. In the present embodiment, bottom sublayer 260*b* is the more cushioning layer and is disposed only above the leveled-out portion of wedge 258.

Figure 11:
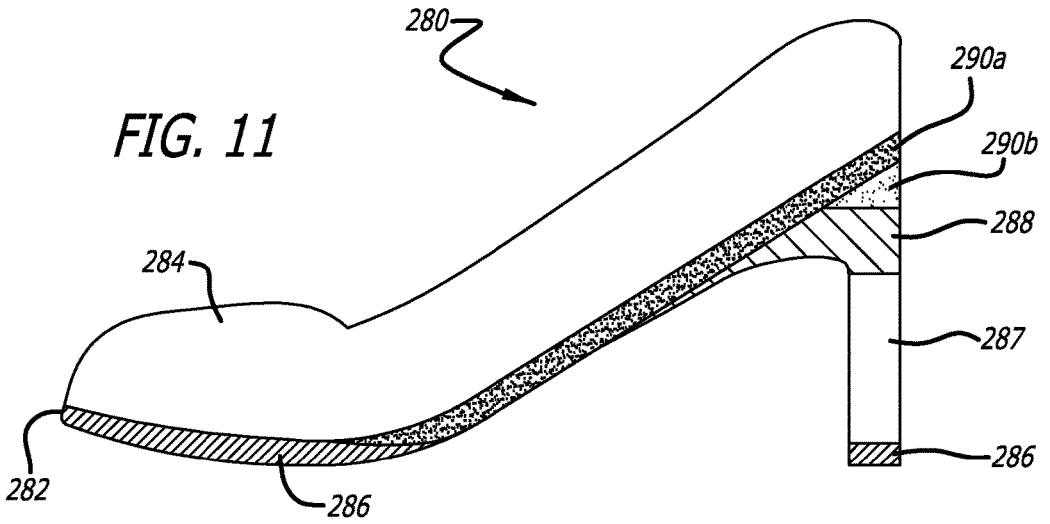
FIG. 11 is a side elevation of a shoe with a spike heel, a larger leveled-out wedge and a cushioning element that is disposed only above the leveled-out portion of the wedge.

FIG. 11 illustrates a shoe 280 according to a still further embodiment. Similar to shoe 250, shoe 280 includes a sole 282 and an upper 284, with sole 252, in turn, including an outsole 286, a spike heel 287, a wedge 288, and a layer of material 290 (comprising multiple sublayers 290*a* and 290*b*) above the wedge 288. Each of the components of shoe 280 is similar to the corresponding component of shoe 250, and the same considerations apply. The main difference between shoe 280 and shoe 250 is the shape of wedge 288. In the present embodiment, both the top and bottom surfaces of the front portion of wedge 288 slope upwardly toward the rear, with its top surface generally following the contour of the bottom surface of top sublayer 290*a* and with its bottom surface smoothly transitioning from generally following the contour of the bottom surface of top sublayer 290*a* to approximately horizontal and then continuing on to smoothly transition to heel 287. As a result, wedge 288: (1) blends more naturally with the other components of shoe 280, thereby potentially providing a more stylish effect; (2) extends further forward than wedge 258 (e.g., such that its top surface extends approximately to the midsection of sole 252 in the present embodiment), thereby, e.g., potentially providing greater support; and (3) potentially has a larger leveled-out surface, while still allowing for a spike heel 287 that is the same or approximately the same height as heel 257. As in the previous embodiment, wedge 288 is a separate component in the present embodiment, but in alternate embodiments could be integrated with heel 287 as a unitary component. Moreover, even when implemented as separate components, the dividing surface between wedge 288 and heel 287 can be adjusted as desired (e.g., higher or lower than as illustrated in FIG. 11).

In any of the foregoing embodiments, the transition from the upwardly sloping surface of the wedge to its leveled-out portion could be abrupt (e.g., as shown in FIGS. 10 and 11) or could be more gradual and smoothly curved. Similarly, the leveled-out portion in any of the embodiments of the present invention could be completely horizontal or could have any other desired contour and/or slope.

Still further, in many of the embodiments described above, the cushion is disposed only above the leveled-out portion of the top surface of the wedge. However, in other embodiments the cushion also extends above other parts of the wedge's top surface (e.g., the transition region between the inclined portion and the leveled-out portion and, potentially, at least a part of the inclined portion itself).

Additional Considerations.

In the event of any conflict or inconsistency between the disclosure explicitly set forth herein or in the attached drawings, on the one hand, and any materials incorporated by reference herein, on the other, the present disclosure shall take precedence. In the event of any conflict or inconsistency between the disclosures of any applications or patents incorporated by reference herein, the more recently filed disclosure shall take precedence.

Several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. Similarly, any two or more adjacent individual components can be integrated into a single component, or any single component can be divided into two or more distinct (e.g., attached) components. For example, any of the insert pieces mentioned above can be integrated with any adjacent component to form a single component, particularly, but not necessarily, when such components are to be made of the same material. More generally, the precise distribution of functionality, as well as any separation into multiple components, preferably is made according to known manufacturing, engineering and/or aesthetic tradeoffs, with reference to the specific embodiment of the invention, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

What is claimed is:

1. A high-heeled shoe, comprising:

a heel component which significantly elevates a rear portion of said high-heeled shoe, as compared to a front portion of said high-heeled shoe;

a sole having a layer of material disposed above the heel component;

a wedge-shaped component disposed between said heel component and said layer of material, wherein said wedge-shaped component includes a top surface with a front portion that inclines upwardly from a front section toward a rear section until reaching a transition edge and then turns substantially horizontal with respect to a bottom surface of an outsole at the heel component; and an upper extending above and attached to the sole, wherein a top surface of the layer of material is inclined upwardly from the at least one of the front or middle portion of the high-heeled shoe to the rear portion of the high-heeled shoe, and wherein the layer of material increases in thickness at the rear portion of said high-heeled shoe, providing substantially more cushioning at said rear portion of said high-heeled shoe.

2. A high-heeled shoe according to claim 1, wherein the wedge-shaped component is completely embedded within an outer material of the sole and, therefore, the wedge-shaped component is hidden from view.

3. A high-heeled shoe according to claim 1, wherein the wedge-shaped component is substantially rigid.

4. A high-heeled shoe according to claim 1, wherein the layer of material comprises a plurality of sublayers.

5. A high-heeled shoe according to claim 1, wherein the layer of material comprises a separate cushioning element disposed only at the rear portion of said high-heeled shoe.

6. A high-heeled shoe according to claim 1, wherein sidewalls of the layer of material also constitute sidewalls of the sole.

7. A high-heeled shoe according to claim 1, wherein the sole further comprises an insole disposed above the layer of material.

8. A high-heeled shoe according to claim 7, wherein the top surface of the layer of material at least approximately parallels the insole.

9. A high-heeled shoe according to claim 1, wherein the layer of material is formed from a single, uniform type of material.

10. A high-heeled shoe according to claim 1, wherein the layer of material is much thicker at the rear portion of the high-heeled shoe than said layer of material is within a middle section of the high-heeled shoe.

11. A high-heeled shoe according to claim 1, wherein the layer of material extends approximately from a metatarsal region to the rear portion of said high-heeled shoe.

12. A high-heeled shoe according to claim 1, wherein the heel component includes a spike heel.

13. A high-heeled shoe according to claim 12, wherein the wedge-shaped component is integrated together with the spike heel as a unitary piece.

14. A high-heeled shoe according to claim 1, wherein the top surface of the front portion of the wedge-shaped component has a front-to-rear upward slope that approximately matches a slope of the top surface of the layer of material.

15. A high-heeled shoe according to claim 1, wherein the layer of material is substantially more cushioning than the heel component.

16. A high-heeled shoe according to claim 1, wherein the layer of material increases in thickness from a front of the heel component to a rear of the heel component.

17. A high-heeled shoe according to claim 16, wherein the layer of material increases in thickness only in a rear portion of said high-heeled shoe.

18. A high-heeled shoe according to claim 1, wherein when traversing from front to rear, a support surface underneath the layer of material slopes upwardly and then levels off, while the layer of material continues to slope upwardly, thereby providing said increase in thickness of said layer of material at the rear portion of said high-heeled shoe.

19. A high-heeled shoe according to claim 1, wherein the top surface of said layer of material maintains a substantially constant angle of inclination.

* * * * *